US009624705B2

(12) United States Patent
Haab et al.

(10) Patent No.: US 9,624,705 B2
(45) Date of Patent: Apr. 18, 2017

(54) DISPLACEMENT DEVICE FOR SLIDABLE AND TURNABLE SEPARATION ELEMENTS AND FUNCTIONAL ENTITY

(71) Applicant: HAWA AG, Mettmenstetten (CH)

(72) Inventors: Gregor Haab, Allenwinden (CH); Peter Ettmüller, Jonen (CH); Martin Frei, Ottenbach (CH); Stefan Hagger, Boppelsen (CH)

(73) Assignee: HAWA AG, Mettmenstetten (CH)

( * ) Notice: Subject to any disclaimer, the term of this patent is extended or adjusted under 35 U.S.C. 154(b) by 0 days.

(21) Appl. No.: 15/006,815

(22) Filed: Jan. 26, 2016

(65) Prior Publication Data

US 2016/0201368 A1 Jul. 14, 2016

Related U.S. Application Data

(63) Continuation of application No. 14/081,727, filed on Nov. 15, 2013, now Pat. No. 9,284,761.

(30) Foreign Application Priority Data

Dec. 5, 2012 (EP) ..... 12195580

(51) Int. Cl.
*E05D 3/04* (2006.01)
*E05D 7/00* (2006.01)
(Continued)

(52) U.S. Cl.
CPC ..... *E05D 7/00* (2013.01); *E05D 3/04* (2013.01); *E05D 7/0423* (2013.01); *E05D 13/00* (2013.01);
(Continued)

(58) Field of Classification Search
CPC ..... Y10T 16/546; Y10T 16/5595; Y10T 16/3831; Y10T 16/3828; Y10T 16/381;
(Continued)

(56) References Cited

U.S. PATENT DOCUMENTS 130,729 A * 8/1872 Long ..... E05D 3/04 16/365
423,952 A * 3/1890 Prindle ..... E05D 15/0634 16/105
(Continued)

FOREIGN PATENT DOCUMENTS

| | | | |
|---|---|---|---|
| DE | 20108229 | U1 | 9/2001 |
| EP | 0433726 | A1 | 6/1991 |
| EP | 2246509 | A1 | 11/2010 |

OTHER PUBLICATIONS

Apr. 18, 2013 Extended European Search Report issued in European Application No. 12195580.1.

*Primary Examiner* — Jeffrey O Brien
(74) *Attorney, Agent, or Firm* — Oliff PLC

(57) ABSTRACT

The displacement device includes a guide carriage that is slidable along a running rail and that is pivotally connectable to a first separation element. The guide carriage includes a carriage body with a carriage head and a carriage foot, which carriage head and carriage foot are connected with one another by a connecting beam, wherein the carriage head holds at least one support wheel and at least two guide wheels and wherein the carriage foot is connected torque proof with a first end piece of a hinge lever, whose second end piece is pivotally held by a hinge shaft that is connectable to a sidewall of the first separation element.

10 Claims, 15 Drawing Sheets

(51) Int. Cl.

| | |
|---|---|
| ***E05D 13/00*** | (2006.01) |
| ***E05D 7/04*** | (2006.01) |
| ***E05D 15/26*** | (2006.01) |
| ***E05F 15/605*** | (2015.01) |
| *E06B 3/50* | (2006.01) |
| *E05D 15/58* | (2006.01) |
| *E05D 15/06* | (2006.01) |
| *E05D 5/08* | (2006.01) |

(52) U.S. Cl.
CPC ..... *E05D 15/063* (2013.01); *E05D 15/264* (2013.01); *E05D 15/58* (2013.01); *E05F 15/605* (2015.01); *E05D 5/08* (2013.01); *E05D 15/0634* (2013.01); *E05D 2015/586* (2013.01); *E05Y 2600/314* (2013.01); *E05Y 2600/324* (2013.01); *E05Y 2900/20* (2013.01); *E05Y 2900/212* (2013.01); *E06B 3/5045* (2013.01); *Y10T 16/33* (2015.01); *Y10T 16/364* (2015.01); *Y10T 16/381* (2015.01); *Y10T 16/3828* (2015.01); *Y10T 16/3831* (2015.01)

(58) Field of Classification Search
CPC ..... Y10T 16/364; A47K 13/12; E05D 3/04; E05D 15/264; E05D 15/0634; E05D 15/58; E05D 2015/586; E06B 3/5045
See application file for complete search history.

(56) References Cited

U.S. PATENT DOCUMENTS 524,609 A * 8/1894 Prouty ..... E05D 15/0634 16/105
632,607 A * 9/1899 Wernicke ..... A47B 88/06 109/70
1,010,949 A * 12/1911 Polverino ..... E05D 3/04 16/365
1,120,898 A * 12/1914 Brandlein ..... E05D 3/04 16/365
1,180,254 A * 4/1916 Carver ..... B62D 25/105 16/365
1,243,499 A * 10/1917 Ferris ..... E05D 15/26 16/97
1,304,751 A * 5/1919 Drlica ..... B62D 25/105 16/365
1,421,068 A * 6/1922 Covi ..... E05D 7/009 16/365
1,446,814 A * 2/1923 Scott ..... B62D 25/105 16/365
1,454,257 A * 5/1923 Ackerman ..... E05D 7/009 16/365
1,797,802 A * 3/1931 Soss ..... E05D 3/16 16/369
1,821,697 A * 9/1931 Ferris ..... E05D 15/12 16/104
1,824,451 A * 9/1931 Soss ..... E05D 1/04 16/355
2,372,431 A * 3/1945 Kahle ..... E05D 3/12 16/371
2,624,067 A * 1/1953 Tassell ..... E05D 5/065 16/389
2,783,493 A * 3/1957 Gussack ..... E05D 15/0634 16/97
2,936,206 A * 5/1960 Wilmer ..... E05D 15/58 109/70
3,075,235 A * 1/1963 Albinson ..... E05D 3/04 16/384
3,456,995 A * 7/1969 Nyquist ..... E05D 15/58 312/110
4,729,612 A * 3/1988 Stone ..... E05D 15/58 312/109
4,974,912 A * 12/1990 Rask ..... E05D 15/58 312/110
4,976,502 A * 12/1990 Kelley ..... A47B 83/001 312/322
5,085,262 A * 2/1992 Tutikawa ..... E05D 15/26 160/199
5,090,171 A * 2/1992 Kano ..... E04B 2/827 160/199
5,108,165 A * 4/1992 Rorke ..... A47B 96/00 312/322
5,121,976 A * 6/1992 Haab ..... E05D 15/58 312/322
5,131,449 A * 7/1992 Winn ..... E05D 15/264 160/199
5,149,180 A * 9/1992 Haab ..... E05D 15/58 312/322
5,391,049 A * 2/1995 Reschlein ..... B65G 57/302 16/365
5,395,165 A * 3/1995 Woerner ..... E05D 15/58 211/27
5,404,675 A * 4/1995 Schmidhauser ..... E05D 15/063 16/87.4 R
6,052,867 A * 4/2000 Haab ..... E05D 15/063 16/87 R
6,618,900 B2 * 9/2003 Spork ..... E05D 11/1007 16/102
6,679,013 B2 * 1/2004 Hornung ..... E06B 3/24 52/204.53
7,578,096 B2 * 8/2009 Haab ..... E05F 15/638 16/87 R
7,653,969 B2 * 2/2010 Erskine ..... E05D 7/00 16/269
7,931,067 B2 * 4/2011 Goodman ..... E05D 15/26 16/365
7,959,242 B2 * 6/2011 Del Castillo ..... E05D 15/58 312/319.1
8,303,056 B2 * 11/2012 Giorgi ..... E05D 15/264 160/201
8,336,972 B2 * 12/2012 Haab ..... E05D 15/0634 16/366
8,522,398 B2 * 9/2013 Haab ..... E05D 15/0634 16/102
8,695,165 B2 * 4/2014 Pelekanos ..... E05D 15/26 16/105
8,739,367 B2 * 6/2014 Park ..... E05D 5/06 16/240
8,869,351 B2 * 10/2014 Chen ..... E05D 15/063 16/106
8,938,856 B1 * 1/2015 Shin ..... E05D 3/06 16/365
9,032,588 B2 * 5/2015 Chen ..... E06B 7/28 16/106
2002/0170234 A1 * 11/2002 Salice ..... E05D 15/063 49/453
2004/0100171 A1 * 5/2004 Brown ..... E06B 3/5045 312/322
2010/0269291 A1 * 10/2010 Haab ..... E05D 15/0634 16/91
2010/0270898 A1 * 10/2010 Haab ..... E05D 15/0634 312/323
2011/0041286 A1 * 2/2011 Busch ..... E05D 15/063 16/91
2012/0240352 A9 * 9/2012 Kondash ..... E06B 3/481 16/91
2014/0251555 A1 * 9/2014 Pelekanos ..... E05D 15/26 160/134

* cited by examiner 29A
29B
26
20
21
22
2291
91
220
2281
22810
2202
2283
2201
92
8
x8
81
82
83
831
2
32
323
x9
h
a
3221
321
322
a*
r

DISPLACEMENT DEVICE FOR SLIDABLE AND TURNABLE SEPARATION ELEMENTS AND FUNCTIONAL ENTITY

This is a Continuation of application Ser. No. 14/081,727 filed Nov. 15, 2013, which claims priority of European Patent Application No. 12195580.1 filed Dec. 5, 2012. The disclosure of the prior applications are hereby incorporated by reference herein in their entireties.

TECHNICAL FIELD

The invention relates to a displacement device for slidable and turnable separation elements and to a functional entity with foldable separation elements that are equipped with such a displacement device.

BACKGROUND SUMMARY

Turnable and slidable separation elements are often used for partitioning and closing functional entities. For opening the functional entity, the slidable separation elements are turned, folded and preferably driven into a door compartment. Parked within the door compartment, the separation elements are no longer an obstacle, wherefore the functional entity can freely be accessed. After termination of the work in the functional entity, it can again be closed by pulling the separation elements out of the door compartment and by unfolding and moving the separation elements along the front side of the functional entity. Functional entities can be for example wardrobes or cupboards designed for storing material. Further, functional entities can be working areas or building units, such as a kitchen, that shall be closed after use, in order to prevent further access to the functional entity or in order to present an aesthetical front, instead of the working area.

[1], U.S. Pat. No. 8,336,972B2, discloses a furniture unit with a displacement device, with which a door, which is pivotally held by a mounting bracket, can be moved from a closed position into a door compartment. The mounting bracket is held vertically aligned when moving in and out of the door compartment by a scissor assembly that comprises two scissor beams that are connected by a joint. In addition, the upper and the lower side of the mounting bracket are connected to carriages that are guided along auxiliary rails that extend inside the door compartment.

[2], U.S. Pat. No. 8,303,056B2, discloses a wardrobe with a sliding foldaway door, which is foldable and can then be moved into a door compartment. The foldable door comprises a first door wing, which on one side is connected to a mounting bracket, which can be driven into the door compartment and which is pivotally connected on the other side to a second door wing. The second door wing is guided by two guiding devices, the first guiding device pivotally connected above the upper edge of the second door wing and the second guiding device pivotally connected below the lower edge of the second door wing. Further, the guide devices are movable along guide tracks, which extend along the front side of the wardrobe and further into the door compartment. An intermediate panel is arranged between the two door wings, which intermediate panel is connected with hinges to the first and the second door wing.

The arrangement of guide tracks along the lower side and the upper side of the wardrobe as well as the arrangement of guide carriages at the lower side and the upper side of the second door wing requires significant space and a specific embodiment of the wardrobe. Hence, this device cannot be used universally and is limited to the use in wardrobes that are equipped with the mentioned device elements at the lower side and the upper side.

Hence, the present invention is based on the object of providing an improved displacement device, with which slidable and turnable separation elements can advantageously be held and operated.

Further, an improved functional entity with foldable separation elements shall be created, which is equipped with the inventive displacement device.

The separation elements of the inventive displacement device shall be movable with only one hand with minimal force. Thereby, it shall be ensured, that the process of folding the separation elements can be performed smoothly. Noise and mechanical stresses shall be avoided when operating the displacement device.

With the inventive displacement device any functional entity, such as wardrobes, cupboards and working areas or building units, particularly kitchen, shall preferably be closable with one or a plurality of separation elements, particularly a plurality of foldable separation elements.

The inventive displacement device shall not appear distracting and shall require little space. In the state, in which the separation elements are opened, no elements of the displacement device shall be visible. Bezels and covers with which device parts need to be covered shall not be required.

Furthermore, the separation elements shall firmly be held, so that adjustments can be avoided or reduced to a minimum. However, in the event that an adjustment is required, then little effort shall be required.

These problems are solved with a displacement device and with a functional entity provided with such a displacement device, which comprise the features of claims 1 and 11, respectively. Preferred embodiments of the invention, particularly a hinge in a preferred embodiment, are defined in further claims.

The displacement device comprises a guide carriage that is slidable along a running rail and that is pivotally connectable to a first separation element.

According to the invention, the guide carriage comprises a carriage body with a carriage head and a carriage foot, which carriage head and carriage foot are connected with one another by a connecting beam. The carriage head holds at least one support wheel and at least two guide wheels and wherein the carriage foot is connected torque proof with a first end piece of a hinge lever, whose second end piece is pivotally held by a hinge shaft that is connectable to a sidewall of the first separation element.

The hinge lever is connected to the carriage foot and designed in such a way, that the hinge lever holds the guide hinge on the first side or the second side of the rail plate.

With the inventive displacement device a separation element, e.g. a sliding door made from wood or glass, can firmly be held and moved along a running rail and can simultaneously be turned. In preferred embodiments, the separation element can be turned by 180°, so that, if aligned in parallel to the running rail, the front side or the backside of the separation element is facing the user. Hence, the front side of the separation element can be moved into the one or the other direction along the running rail, whereby the separation element can execute a required rotation.

The displacement device requires little space and does not engage into the space above the functional entity. The functional entity, e.g. a wardrobe or cupboard, can therefore precisely be fitted into a space provided therefore, without requiring additional space for the displacement device. The displacement device can be inserted in a conventional functional entity that can be installed, in a room without restrictions or limitations.

In preferred embodiments the at least one support wheel and the guide wheels are arranged on the one side and the guide hinge and the separation element on the other side of the rail plate. In spite of the fact that the displacement device is not arranged outside of the functional entity, the displacement device can be arranged in such a way, that it also does not appear distracting inside the functional entity. Hence, bezels and covers are not required.

The inventive displacement device can advantageously be installed in any functional entity. In the event that the displacement device holds one separation element only, then the separation element is preferably guided at its lower side as well. For this purpose, guide carriages are used that comprise two guide wheels each, in order to keep the separation element in vertical alignment. The functional entity can comprise one or a plurality of separation elements that can be moved individually by means of the inventive displacement device. After opening the separation elements can for example be aligned side-by-side and can be stapled in a parking area requiring little space.

Use of the inventive displacement device in a functional entity, which comprises at least a first and a second separation element that are pivotally connected with one another and which can be stored within a door compartment, when the functional entity is opened, is particularly advantageous. The displacement device is mounted laterally at the front side of the leading first separation element and thus can guide the first separation element along a first rail section of the running rail, that runs along the front side the functional entity, and along a second rail section of the running rail, which runs inside the door compartment. During the movement along the running rail, the hinge lever can turn within the guide hinge by 180°, so that the separation element always follows the displacement device that pulls the separation element or is pushed by the separation element.

In further preferred embodiments, the displacement device is provided with a drive unit, e.g. a drive unit which drives a wheel of the guide carriage or a toothed wheel that engages in a tooth belt that runs in parallel to the running rail and preferably is held within the running rail. The drive devices of this kind are known for example from [3], U.S. Pat. No. 7,578,096B2. With a motorised displacement device, both separation elements can be pulled into or pushed out of the door compartment. Subsequently, the motorised displacement device allows folding and again unfolding the two separation elements. Preferably, the two separation elements are connected with one another via an articulated joint, which holds the two separation elements in symmetrical alignment. I.e., the two separation elements are always inclined by identical angles. Hence, the separation elements can be equipped with a single drive device, which can drive the two separation elements, which are connected with one another, out of the door compartment, can unfold, fold and can drive back the separation elements back into the door compartment.

Particularly, if heavy separation elements are used, then motorised carriages are preferably mounted on the distal sides of the separation elements. A motorised guide carriage connected to the first separation element can be used for unfolding and folding of the separation elements, while a motorised auxiliary carriage, which is connected to the second separation element, can drive the separation elements into and out of the door compartment. Furthermore, the inventive displacement device can also be used advantageously, when the separation elements are not driven into a door compartment, but are merely stapled in a terminal position or an intermediate position along the running rail.

Functional entities equipped with the inventive displacement device can manually be operated, since the inventive guiding mechanism requires only a little force. The articulated joint, which connects the two separation elements with one another, is preferably provided with a holding grip, which can manually be operated. By pulling the holding grip, the two separation elements can be pulled out of the door compartment, whereafter the first separation element can further be guided along the first rail section of the running rail by pushing the holding grip back against the functional entity.

In preferred embodiments the guide hinge comprises a hinge cup, which is recessed at the front sided edge of the first separation element and which preferably exhibits a cup recess, through which the hinge lever can be turned towards the outside. This embodiment ensures that the hinge lever can be turned by 180° against the hinge cup and thus can also the held first separation element can be turned by 180° against the running rail.

The use of a concealed hinge with a hinge cup recessed in the separation element allows arranging the hinge shaft within the separation element, wherefore a space-saving solution results. However, the use of a concealed hinge is not required, if the hinge shaft can be held within the separation element by other means. For example, a recess can be provided in the separation element, in which a bearing is inserted, with which the hinge shaft is held. Further, the hinge shaft can also be held on the outside of the separation element, so that a concealed hinge is not required.

The hinge lever preferably comprises a holding sleeve that is held slidable by the hinge shaft. In a preferred embodiment the hinge lever and the hinge cup comprise elements that abut one another without play after the hinge lever has been turned completely into the hinge cup. This feature can be realised for example by providing the hinge cup with a corresponding form. E.g., a recess is embossed into the hinge cup which serves for receiving and holding the hinge lever in the terminal position without play. Alternatively, a cup insert is provided that can be inserted into the hinge cup and that comprises a cup insert recess, into which the hinge lever can be turned and in which the hinge lever is held in the terminal position without play. In this preferred embodiment of the guide hinge a play is provided between the hinge lever and the hinge cup before unfolding the separation elements, which play avoids friction resistances, which otherwise can occur due to minimal differences in the alignment of the separation elements. However, after the separation elements have been folded, they are held precisely without play, so that the separation elements are aligned flush with the other elements of the functional entity, e.g. with the top of the wardrobe.

In a further preferred embodiment the hinge lever is connected with the carriage body in such a way that the hinge lever is vertically adjustable and/or turnable. By the vertical movement of the hinge lever, the separation elements can be lifted and aligned flush with the upper edge of the wardrobe. By turning the hinge lever, the guide hinge can be shifted towards the guide carriage, until the separation elements abut the walls of the wardrobe.

For this purpose, the carriage body, i.e. the carriage foot is preferably provided with a bolt chamber. The hinge lever is provided with a lever block, which comprises a threaded bore, into which the bolt shaft of a mounting bolt can be screwed. The bolt shaft is seated within the bolt chamber aligned vertically, i.e. perpendicularly to the running direction of the guide carriage.

The mounting bolt preferably comprises a bolt head that is seated in a bearing seat provided in the bolt chamber and a cylindrical bolt foot that is inserted into a base opening provided in the bolt chamber. The bolt foot that is extending out of the lower side of the bolt chamber is preferably provided with a coupling element, e.g. a hexagonal opening into which a tool can be inserted, in order to turn the mounting bolt and to shift the hinge lever to a desired height level.

The lever block, which is pivotally held within the bolt chamber, can preferably be fixed in a desired angular position by means of at least one adjustment screw, preferably two adjustment screws that are coaxially aligned. The at least one adjustment screw is arranged eccentric to the axis of rotation of the mounting bolt, so that a lever is obtained, with which the hinge lever can be turned and fixed. In the selected position, the lever block is then firmly held by the adjustment screw or from opposite sides by the two adjustment screws.

The displacement device is guided in the running rail preferably in such a way that no elements of the displacement device and the running mechanism are visible after the functional entity, e.g. the wardrobe or the kitchen, has been opened. According to the invention the at least one support wheel and the at least one guide wheel are engaged on the backside of the running rail, which is designed asymmetrically and which comprises a rail plate that is facing the outside of the functional entity. The running rail comprises a rail foot and a rail head that are adjoining the backside of the rail plate and that serve for guiding the support wheels and the guide wheels. The carriage body is connected in such a way to the hinge lever that the hinge cup and therefore the installed first separation element is held in front of the front side of the rail plate. Hence, when opening or folding the separation elements as well as after laterally moving the separation elements, e.g. into the door compartment, only the front side of the rail plate is visible, behind which the guide carriage with the support wheel and the guide wheels is hidden. Hence, the running rail serves also as a bezel, wherefore a separate bezel and related mounting means are not required.

All in all, a simple, compact, space-saving and cost-efficient set up of the device is achieved. Further, with the use of the inventive displacement device and the running rail a stable setup of the device is obtained, which ensures that also heavier separation elements, particularly foldable separation elements that are connected with one another, can precisely be held and guided. Hence, a guiding device arranged at the lower side of the separation elements is not required. Alternatively, a simplified displacement device or a locking device can be provided at the lower side of the separation elements, which hold and secure the separation elements for example in the terminal position only.

Below, the invention is described in detail with reference to the drawings.

DETAILED DESCRIPTION

Figure 1B:
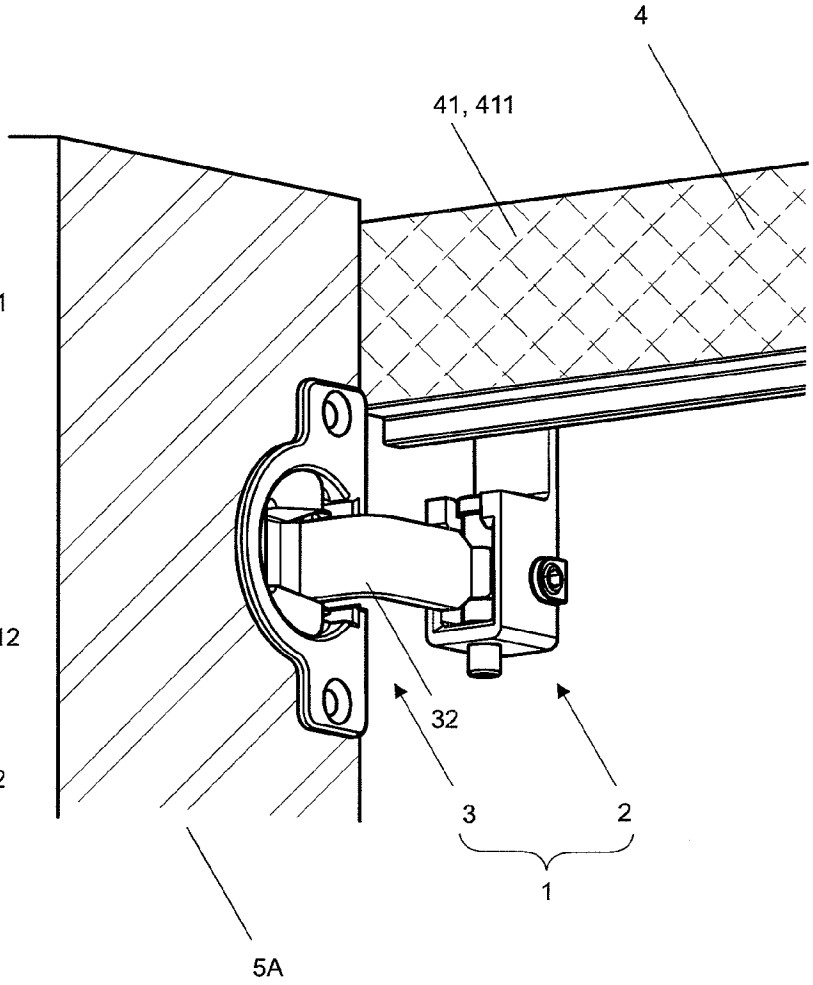
FIG. 1A-C show an inventive displacement device 1 with a guide carriage 2 guided in a running rail 4, which guide carriage 2 is connected via a hinge lever 32 with a guide hinge 3 that is peripherally recessed in the sidewall of a separation element 5A, which is shown in three different positions.
Figure 1A:
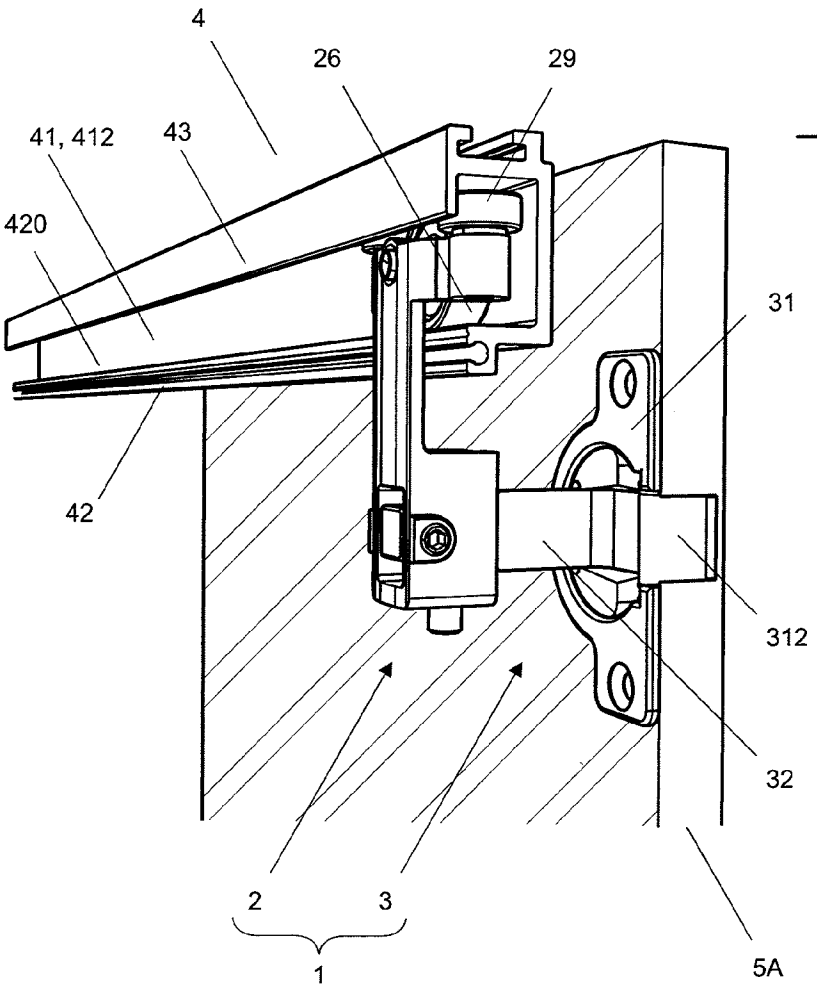
Figure 1C:
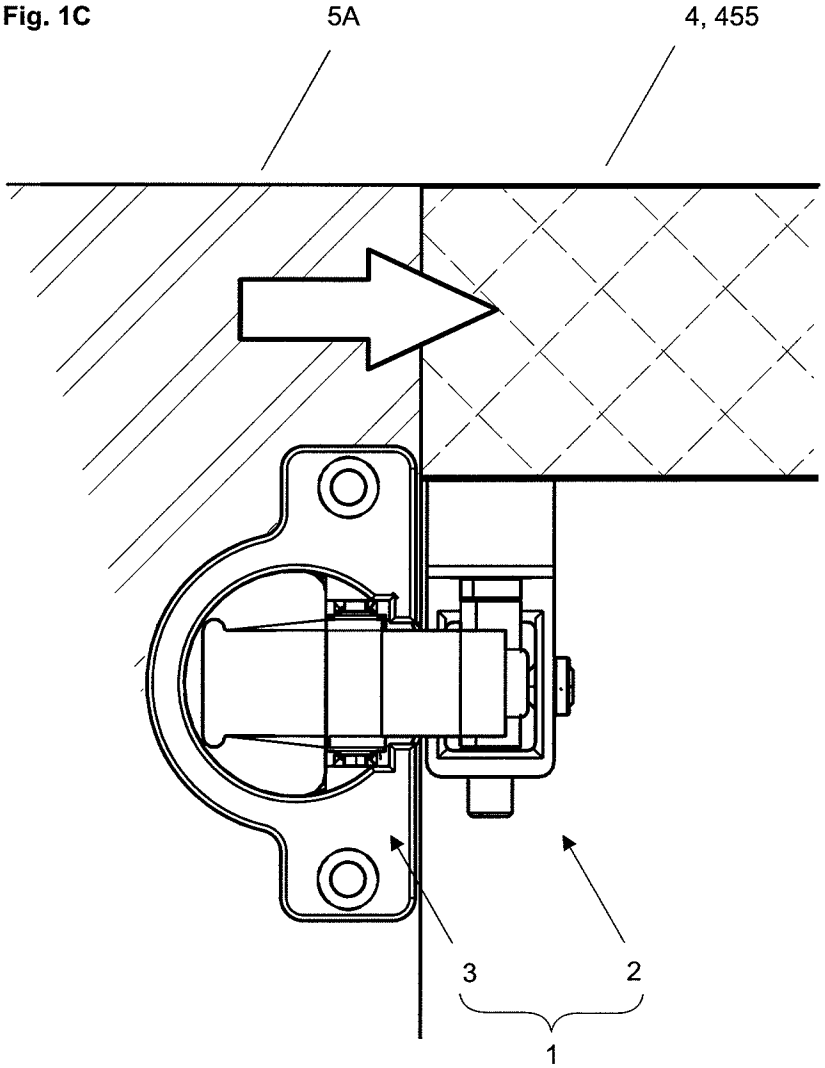

FIG. 1A, FIG. 1B and FIG. 1C show an inventive displacement device 1, which comprises a guide carriage 2 guided in a running rail 4 and a guide hinge 3 that is connected to a first separation element 5A.

The guide carriage 2 comprises a carriage body 20 with a carriage head 23 and a carriage foot 22, which are connected with one another by a connecting beam 21. The carriage head 23 is provided with a horizontal alignment wheel axle 260 serving for holding a support wheel 26 and with two vertically aligned wheel axles 290 serving for holding guide wheels 29A, 29B (see FIG. 3A).

The asymmetrically designed running rail 4 comprises a rail plate 41 that is vertically aligned and that connects a rail head 43 and a rail foot 42 with one another. At the upper side of the rail foot 42 a running surface 420 is horizontally extending, on which the support wheel 26 is running. The two guide wheels 29A and 29B, which hold the guide carriage 2 in alignment in parallel to the running rail 4, are guided within the rail head 43, which exhibits a U-profile that is opened downwards.

The guide carriage 2 and the guide hinge 3, which is recessed in a sidewall of the separation element 5A, are connected with one another via a hinge lever 32, which is held below the running rail 4. Hence, the space above the separation element 5A and above the running rail 4 is kept free, wherefore the displacement device 1 and the running rail 4 can be installed in any functional entity without requiring additional space.

The separation element 5A can be moved along the running rail 4 and be turned as desired by up to 180°. FIG. 1A shows the separation element 5A is aligned parallel to the running rail 4. FIG. 1B shows the separation element 5A opened, i.e. perpendicularly aligned to the running rail 4. FIG. 10 shows the separation element 5A again aligned in parallel to the running rail 4, however turned by 180° compared to the alignment shown in FIG. 1A.

FIG. 1A shows the guide hinge 3 with a hinge cup 31 that is recessed peripherally in a sidewall of the separation element 5A and that exhibits a cup recess 312 which is open towards the front face of the separation element 5A, into which cup recess 312 the hinge lever 32 can be turned, as shown in FIG. 1C.

FIG. 1B shows that after opening and moving the separation element 5A, only the front side 411 of the rail plate 41 of the running rail 4 is visible, which therefore serves as a bezel. Hence, a separate bezel and related mounting devices are not required. The support wheel 26 and the two guide wheels 29 as well as the functional parts of the rail head 43 and of the rail foot 42 are covered aesthetically advantageous by the rail plate 41 and lie within the functional entity. Hence, after the separation element 5A has been moved for example into a door compartment, only the rail plate 41 is visible, which is not distracting and which can be provided with a design if required by the user.

Figure 2B:
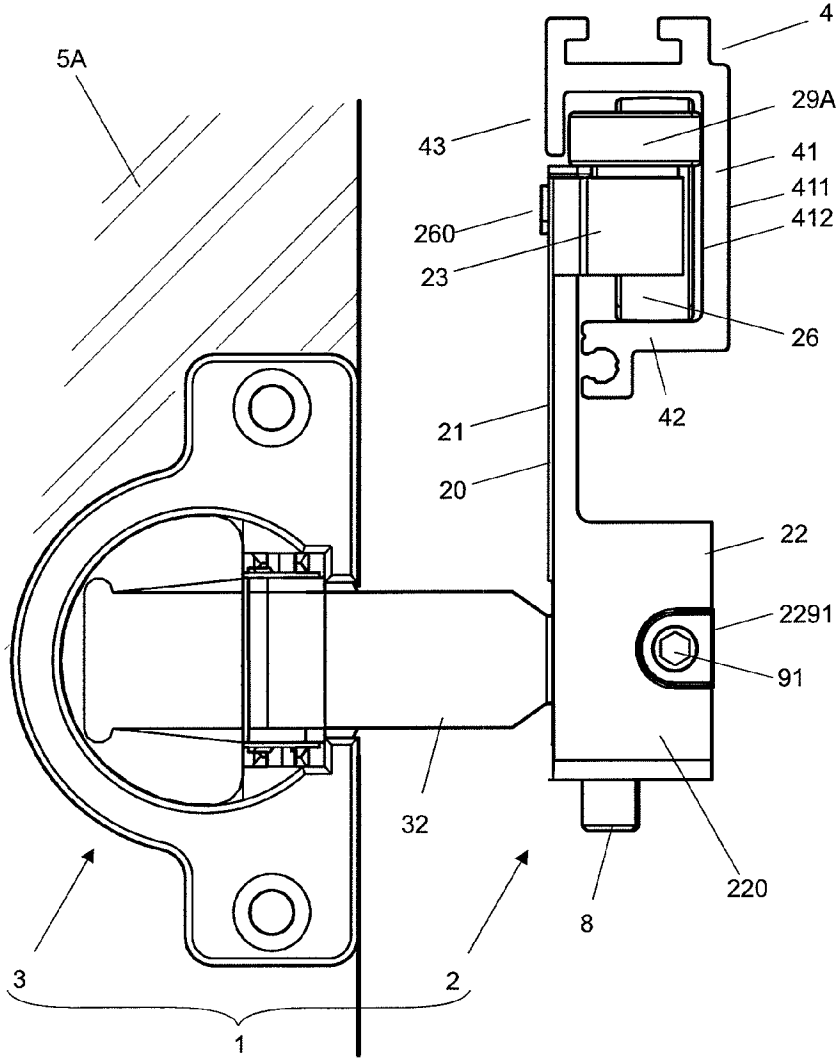
FIG. 2B shows the displacement device 1 of FIG. 2A in an embodiment, in which the separation element 5A as well as the support wheel 26 and the guide wheels 29 are arranged on the same side 411 of the rail plate 41.
Figure 2A:
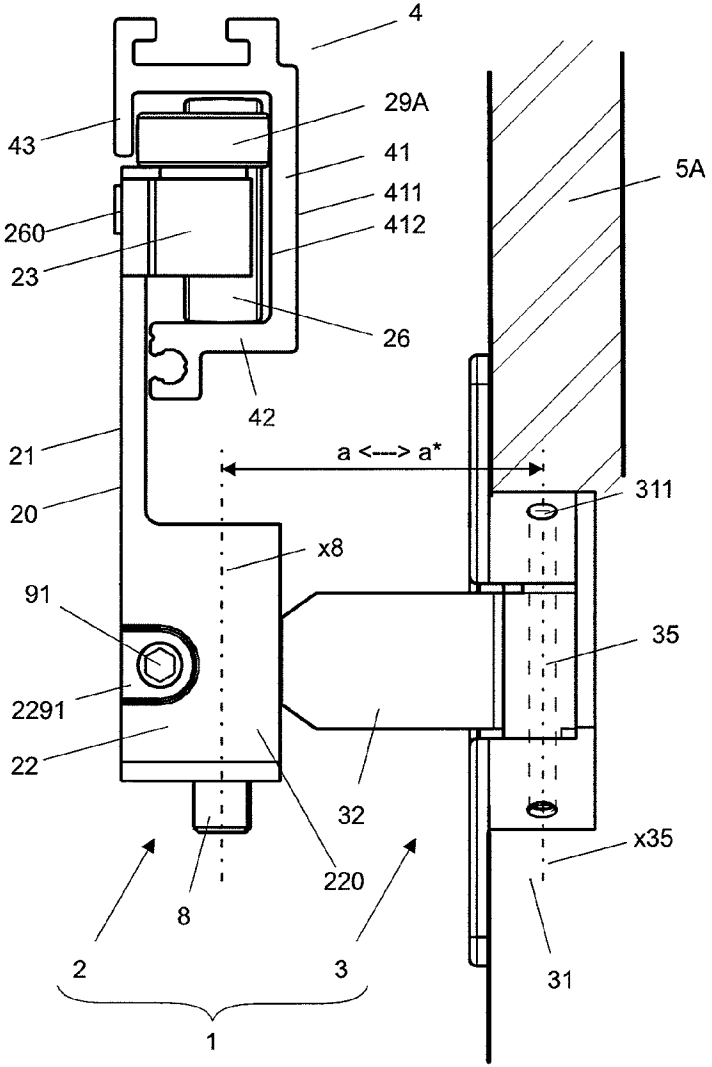
FIG. 2A shows the displacement device 1 of FIG. 1A with the asymmetrical running rail 4, which comprises a rail plate 41 with a rail head 43 and a rail foot 42, in which the support wheel 26 and the guide wheels 29 are guided on one side 412 of the rail plate 41, with the opposite side 411 of the rail plate 41 facing the separation element 5A.

FIGS. 2A, 3A, 3B, 4 and 5 show the displacement device 1 of FIG. 1A in different views. FIG. 2A shows the displacement device 1 from the side with the carriage foot 22 comprising a bolt chamber 220, in which a mounting bolt 8 is seated. In bores 311 in the hinge cup 31, a hinge shaft 35 is seated. The hinge lever 32 is held on one side in the bolt chamber 220 by a mounting bolt 8 and is pivotally held on the other side in the hinge cup 31 by the hinge shaft 35. The distance "a" or "a*", respectively, between the longitudinal axes x8, x35 of the mounting bolt 8 and the hinge shaft 35 can be adjusted by turning the hinge lever 32, which is described below with reference to FIGS. 5A and 5B. After the adjustment, the hinge lever 32 can be fixed in a desired position by means of adjustment screws 91, 92, which are screwed into threaded bores 2291, 2292 provided in the bolt chamber 220 (see FIG. 4).

The rail head 43 of the running rail 4 comprises a guide channel opened downwards for receiving the guide wheels 29A. If additional stabilisation of the guide carriage 2 is desired, then the rail foot 42 is may be provided with a guide channel, which can receive two additional guide wheels. E.g., a U-profile that is opened downwards may be provided that exhibits on the upper side the running surface for guiding the support wheel 26. Hence, the inventive displacement device 1 can interact with different designs of running rails 4, whereby FIG. 2A shows a particularly compact running rail 4.

FIG. 2B shows the displacement device 1 of FIG. 2A in an embodiment, in which the separation element 5A as well as the support wheel 26 and the guide wheels 29 are arranged on the same side 411 of the rail plate 41.

Figure 3B:
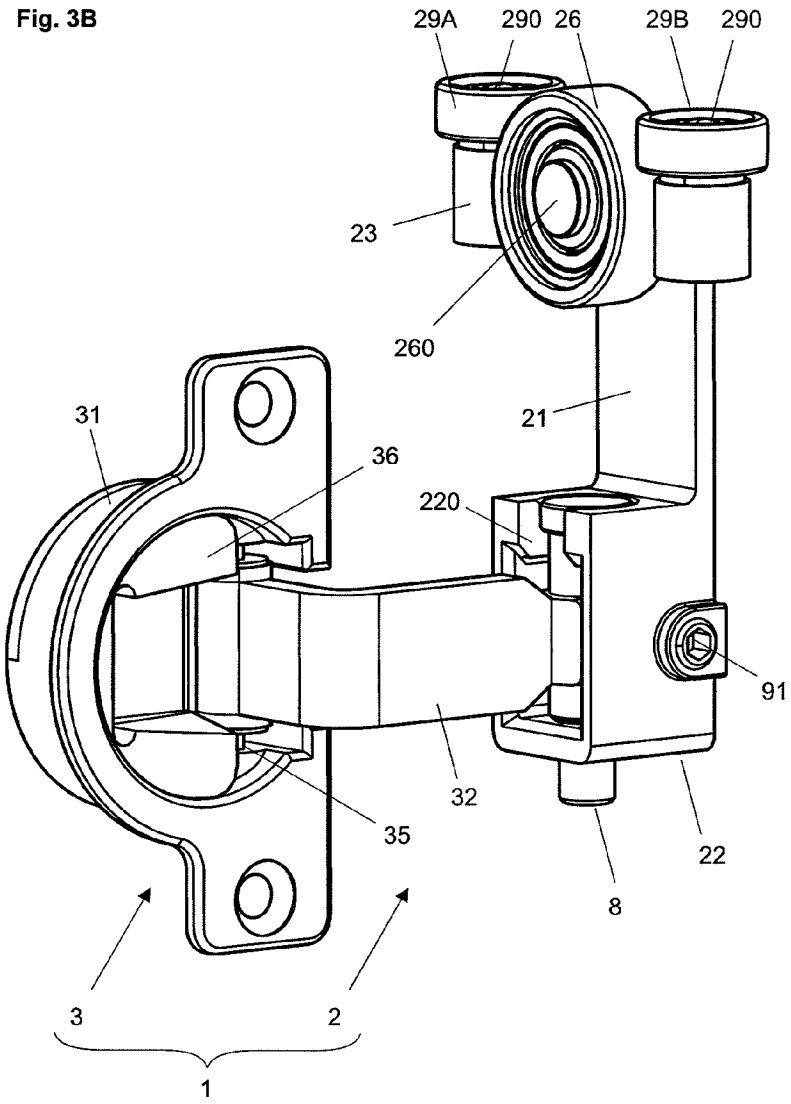
FIG. 3B shows the displacement device 1 of FIG. 3A from a different angle.
Figure 3A:
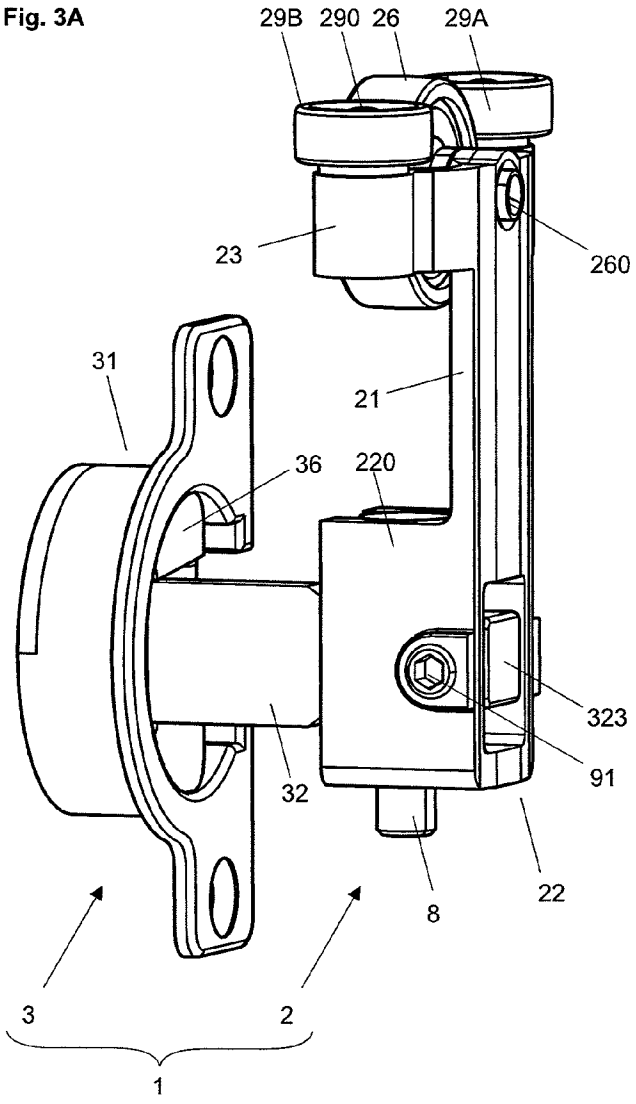
FIG. 3A shows the displacement device 1 of FIG. 1A without separation element in spatial view.

FIG. 3A and FIG. 3B show the displacement device 1 of FIG. 1A and FIG. 1B without separation element. The bolt chamber 220 with mounting bolt 8 inserted therein is shown from two sides.

Figure 4:
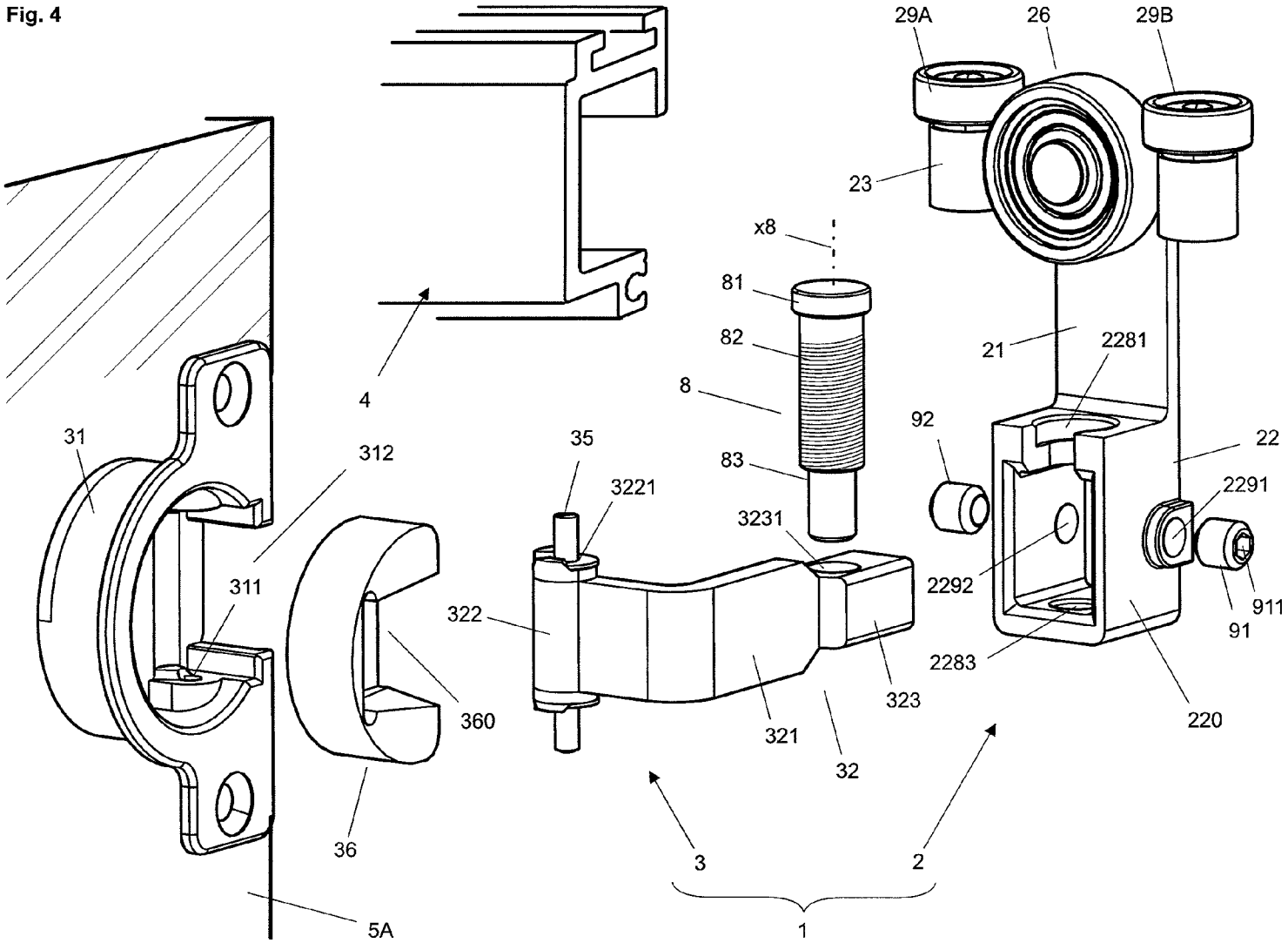
FIG. 4 shows the displacement device 1 of FIG. 1A with the guide carriage 2 and the guide hinge 3 in an explosion view.

FIG. 4 shows the displacement device 1 of FIG. 1A with the guide carriage 2 and the guide hinge 3 in an explosion view. The mounting bolt 8, which comprises a bolt head 81, a bolt shaft 82 with a threading and a cylindrical bolt foot 83, has been removed out of the bolt chamber 220.

Figures 5A, 5B, 5C:
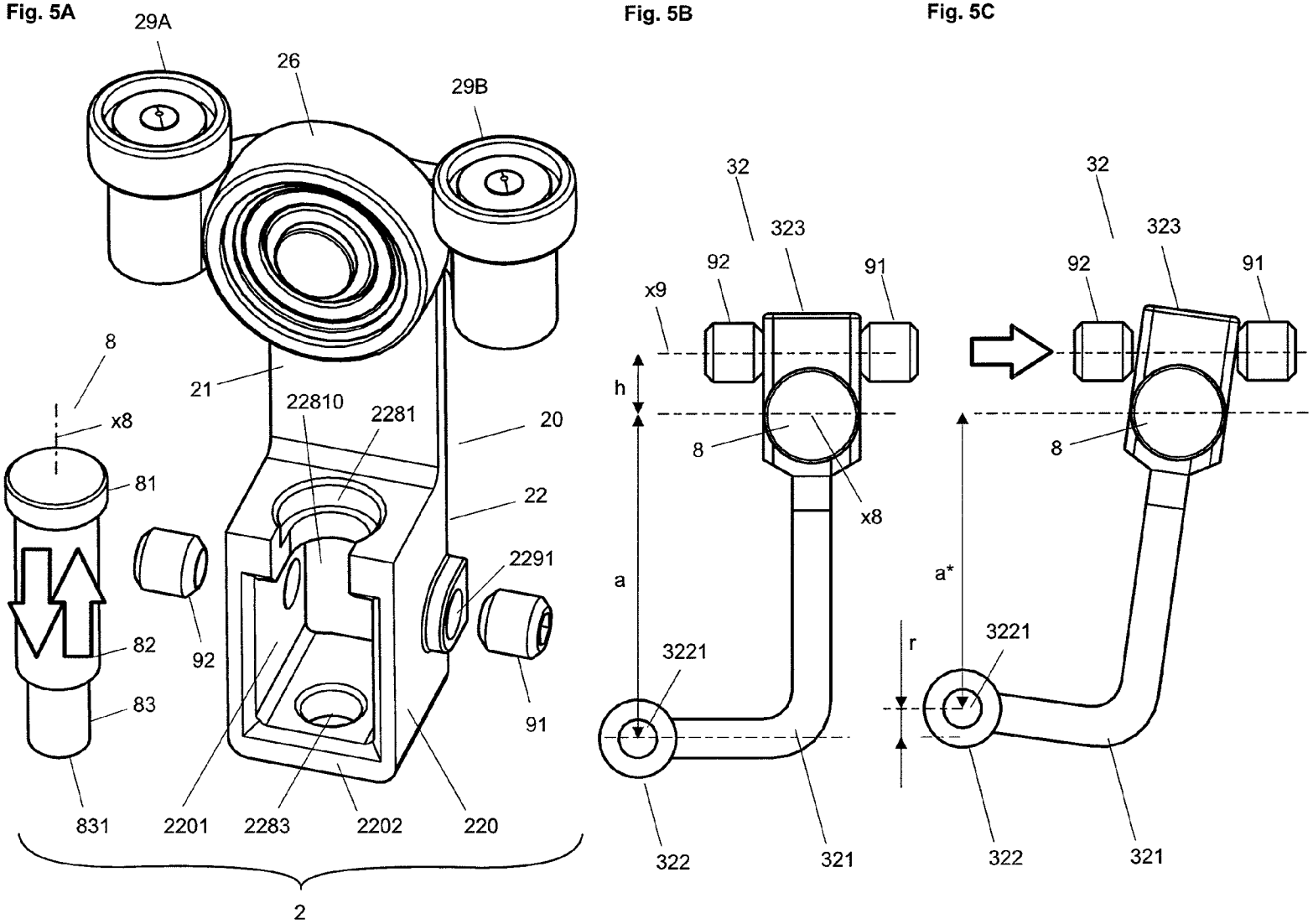
FIG. 5A shows the guide carriage 2 of FIG. 4 with a carriage body 20, which comprises a carriage foot 22 with a bolt chamber 220, out of which two coaxially aligned adjustment screws 91, 92 and a mounting bolt 8 have been removed, which serve for adjusting and fixing the hinge lever 32.
FIG. 5B shows the hinge lever 32 held by the mounting bolt 8 and the adjustment screws 91, 92 inclined.
FIG. 5C shows the hinge lever 32 held by the mounting bolt 8 and the adjustment screws 91, 92, inclined.

FIG. 5A shows the bolt chamber 220 with a bearing seat 2281 on the upper side, which exhibits a front sided seat recess 22810, with a front-sided chamber opening 2201 and on the lower side a chamber base 2202 with a base opening 2283. The mounting bolt 8 can be inserted through the chamber opening 2201 and to the seat recess 22810 into bolt chamber 220 in such a way that the bolt foot 83 can enter the base opening 2283 and the bolt head 81 can be seated into the bearing seat 2281. The bolt shaft 82 which holds the hinge lever 32 is freely exposed in the bolt chamber 220 and can be turned by means of a tool, which can be coupled to the bolt foot 83 that is extending out of the bolt chamber 220. With the engagement of the mounting bolt 8 in the bolt chamber 220, a release protection is implemented. I.e., the separation element 5A that is connected to the guide hinge 3 cannot get released self-acting from the guide carriage 2. Hence, the separation element 5A can provisorily be engaged in the guide carriage 2 and can then be adjusted conveniently.

FIG. 4 further shows the detached hinge lever 32, which comprises a holding sleeve 322 and a lever block 323, which are connected with one another via an L-shaped lever plate 321. The holding sleeve 322 has a cylindrical opening 3221, in which the hinge shaft 35 can be inserted. The lever block 323 comprises a threaded bore 3231, into which the bolt shaft 82 of the mounting bolt 8 can be screwed. When turning the mounting bolt 8 the lever block 323 held inside the bolt chamber 220 and therefore the separation element 5A held by the hinge lever 32 is shifted upwards or downwards. Hence, the height of the separation element 5A can be adjusted. It is further shown that the sidewalls of the bolt chamber 220, which are opposing one another, are provided with coaxially aligned threaded bores 2291, 2292, into which threaded bolts, i.e. the adjustment screw 91, 92, can be turned. The adjustment screws 91, 92 are provided with a coupling element 911 each, such as a hexagonal opening, which can be coupled with a tool.

FIG. 4 further shows that the cup insert 36 can be inserted into the hinge cup 31, whose function is described below with reference to FIGS. 6A-6E.

FIG. 5 shows the bolt chamber 220 with the adjustment screw 91, 92 from a different angle. The mounting bolt 8, which is connected to the lever block 323 of the hinge lever 32, can be inserted from the front side into the bolt chamber 220. The chamber opening 2201 that is provided on the front side is designed in such a way, that the front side of the hinge lever 32 that is held by the mounting bolt 8 can be turned to the left and to the right.

FIG. 5A shows the detached hinge lever 32, which is held by the mounting bolt 8 and the adjustment screws 91, 92, in straight alignment. FIG. 5B shows the hinge lever 32, which is held by the mounting bolt 8 and the adjustment screws 91, 92, inclined. The longitudinal axis x8 of the mounting bolt 8 and the longitudinal axis x9 of the adjustment screws 91, 92 are located a lever distance "h" apart from one another. By turning the adjustment screws 91, 92 the hinge lever 32 can be turned with the result that the distance "a" between a line, which runs in parallel to the running rail 4 and which intersects the longitudinal axis x8 of the mounting bolt 8, and the holding sleeve 322 changes. With a clockwise turn of the hinge lever 32 a smaller distance "a*" results with a turn counter-clockwise of the hinge lever 32 a larger distance "a*" results. In total an adjustment range "r" is reached, which allows suitable adjustment of the distance between the separation element 5A and the running rail 4. By fastening the two adjustment screws 91, 92 the lever block 321 can then be fixed in a selected position.

Figure 6B:
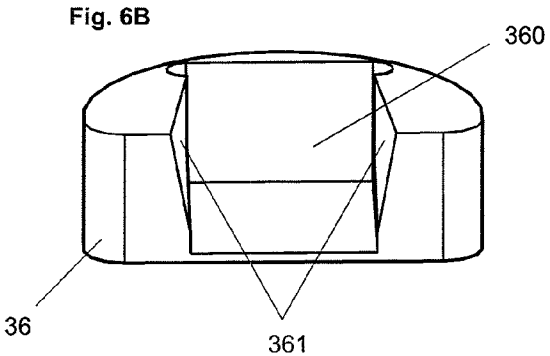
FIG. 6B shows the cup insert 36 of FIG. 6A, which comprises a cup insert recess 360 that narrows towards the inside and that exhibits inclined sidewalls 361.
Figure 6A:
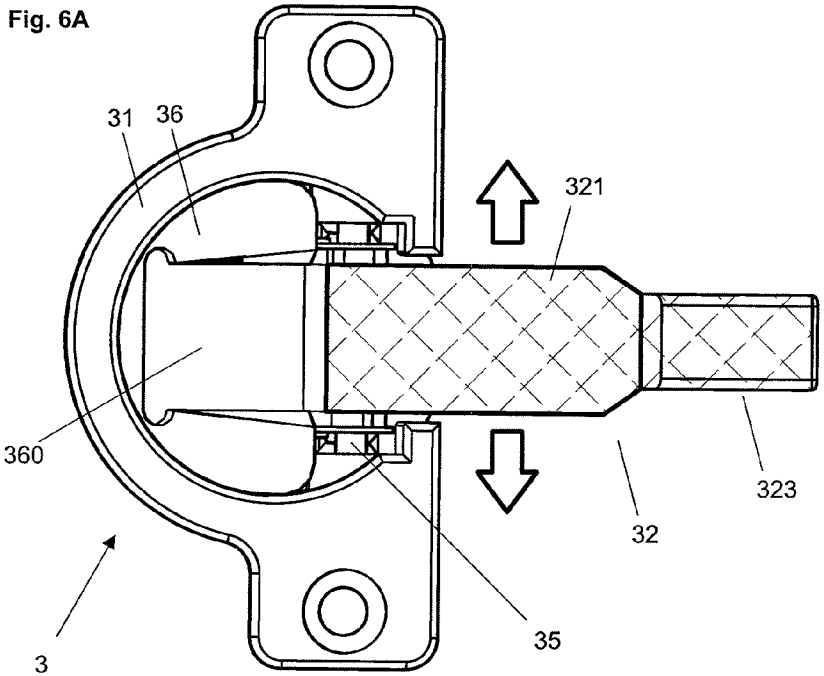
FIG. 6A shows the guide hinge 3 of FIG. 4 with a hinge cup 31, in which a cup insert 36 is held, into which the hinge lever 32 that is held by the hinge shaft 35 can be turned.

FIG. 6A shows the guide hinge 3 of FIG. 4 with the hinge cup 31, in which the cup insert 36 is inserted. The hinge cup 36, which is preferably made from plastic, comprises a cup insert recess 360 that narrows towards the inside and that exhibits inclined sidewalls 361, as shown in FIG. 6B. Hence, the hinge lever 32, which is adapted to the cup insert recess 360 can be turned into the hinge cup 31, i.e. into the cup insert recess 360 provided in the cup insert 36, until it is held in the terminal position by the sidewalls 361 without play. The sidewalls 361, which are inclined towards the inside, serve as inside slope, which grasp and center the hinge lever 32, while it is turned into the terminal position. Hence, turning the separation element 5A held by the hinge lever 32 into the terminal position is executed smoothly without obstacles.

Figure 6C:
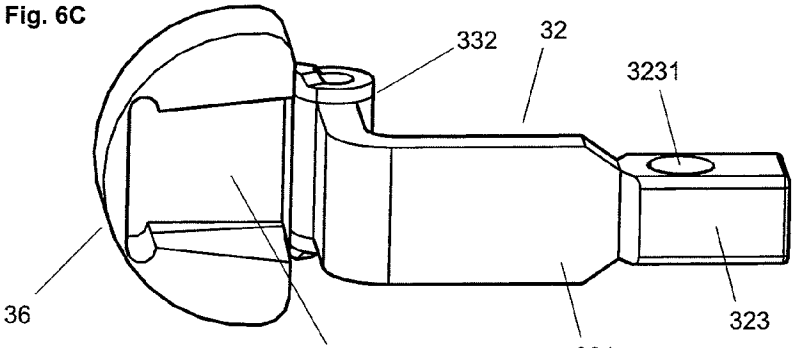
FIG. 6C shows the hinge lever 32, which is released from the cup insert 36 and which is vertically movable along the hinge shaft 35 of FIG. 6A.

FIG. 6A and FIG. 6C show the hinge lever 32 released from the cup insert 36 and held by the hinge shaft 35 only. Hence, the hinge lever 32 can be moved along the hinge shaft 35 upwards and downwards. When turning the separation element 5A, e.g. during the folding process of the two pivotally connected separation elements 5A, 5B shown in FIG. 8, the hinge lever 32 is released from the cup insert 36 and therefore exhibits mechanical play and is movable, in order to compensate misalignments, which can occur under load or after a longer period of operation. Hence, the inventive displacement device 1 provides optimal running properties.

Figure 6D:
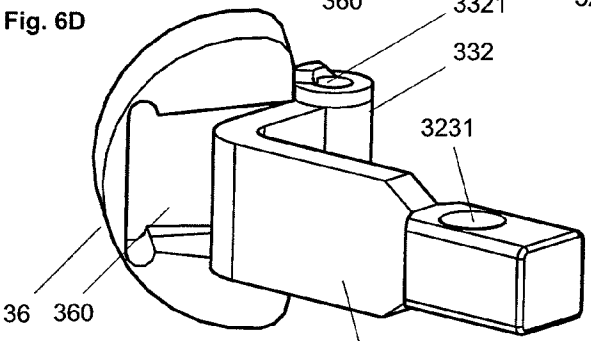
FIG. 6D shows the hinge lever 32 while turning towards the cup insert recess 360.
Figure 6E:
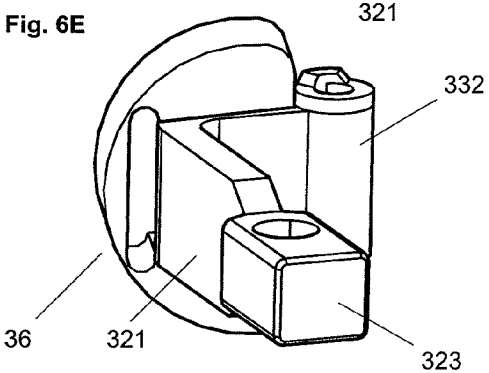
FIG. 6E shows the hinge lever 32 held without play inside the cup insert 36.

FIG. 6D shows the hinge lever 32 while turning into the cup insert recess 360 provided in the cup insert 36. FIG. 6E shows the hinge lever 32 held in the terminal position without play by the cup insert 36.

The inventive displacement device 1 can advantageously be installed in different functional entities, particularly conventional and standardised functional entities. The inventive displacement device can be installed for example in building units, such as kitchens, or wardrobes, which can be closed by foldable separation elements that, after opening, can be folded and be shifted into a door compartment.

Figure 7:
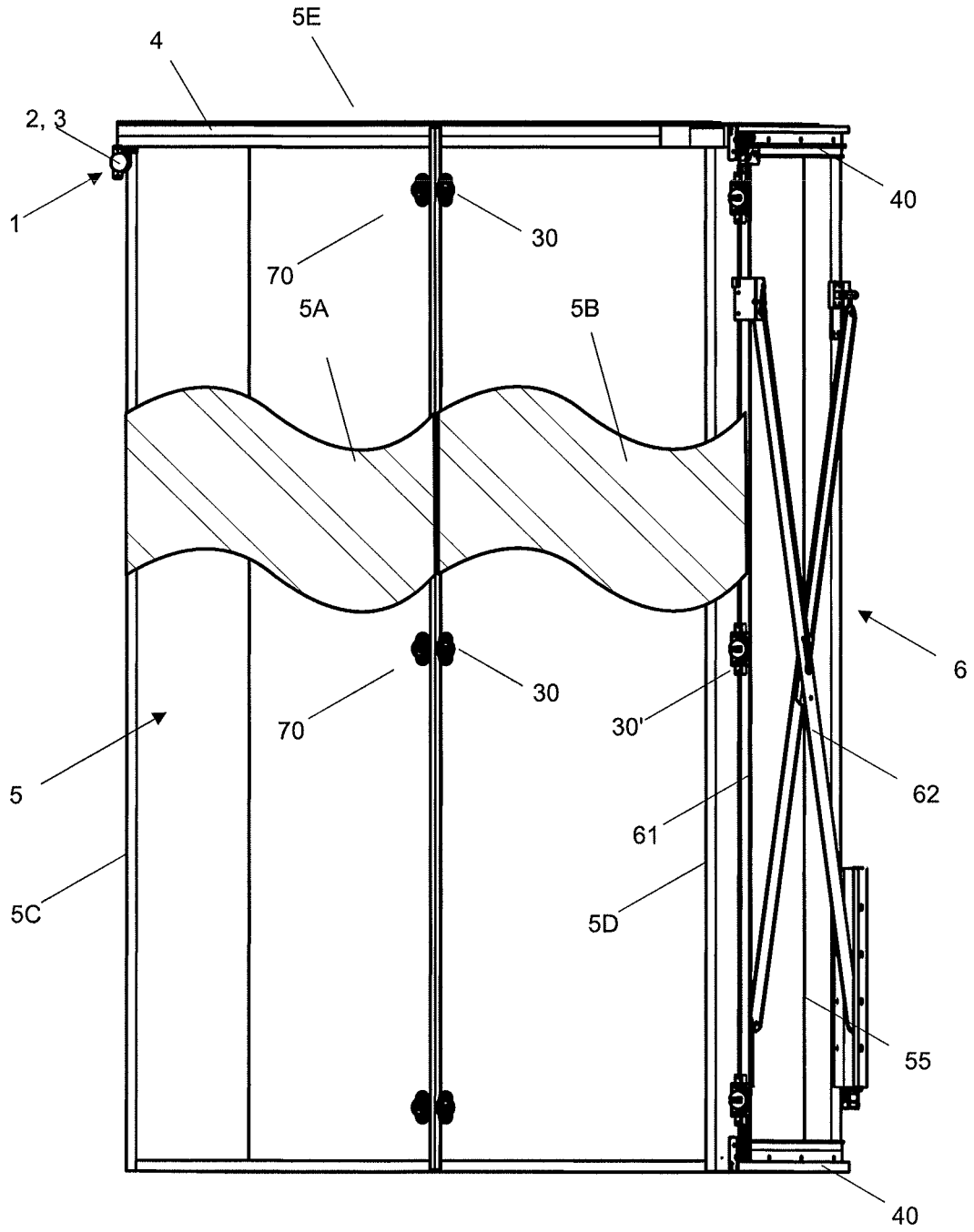
FIG. 7 shows a functional entity, i.e. a wardrobe or a cupboard 5, with two separation elements 5A, 5B, which are foldable towards one another and of which the first separation element 5A, as shown in FIG. 1A, is held on the front side by a displacement device 1 that is guided along a running rail 4 and of which the second separation element 5B is held on the backside in vertical alignment by a mounting bracket 61 and a scissor assembly 62.
Figure 8:
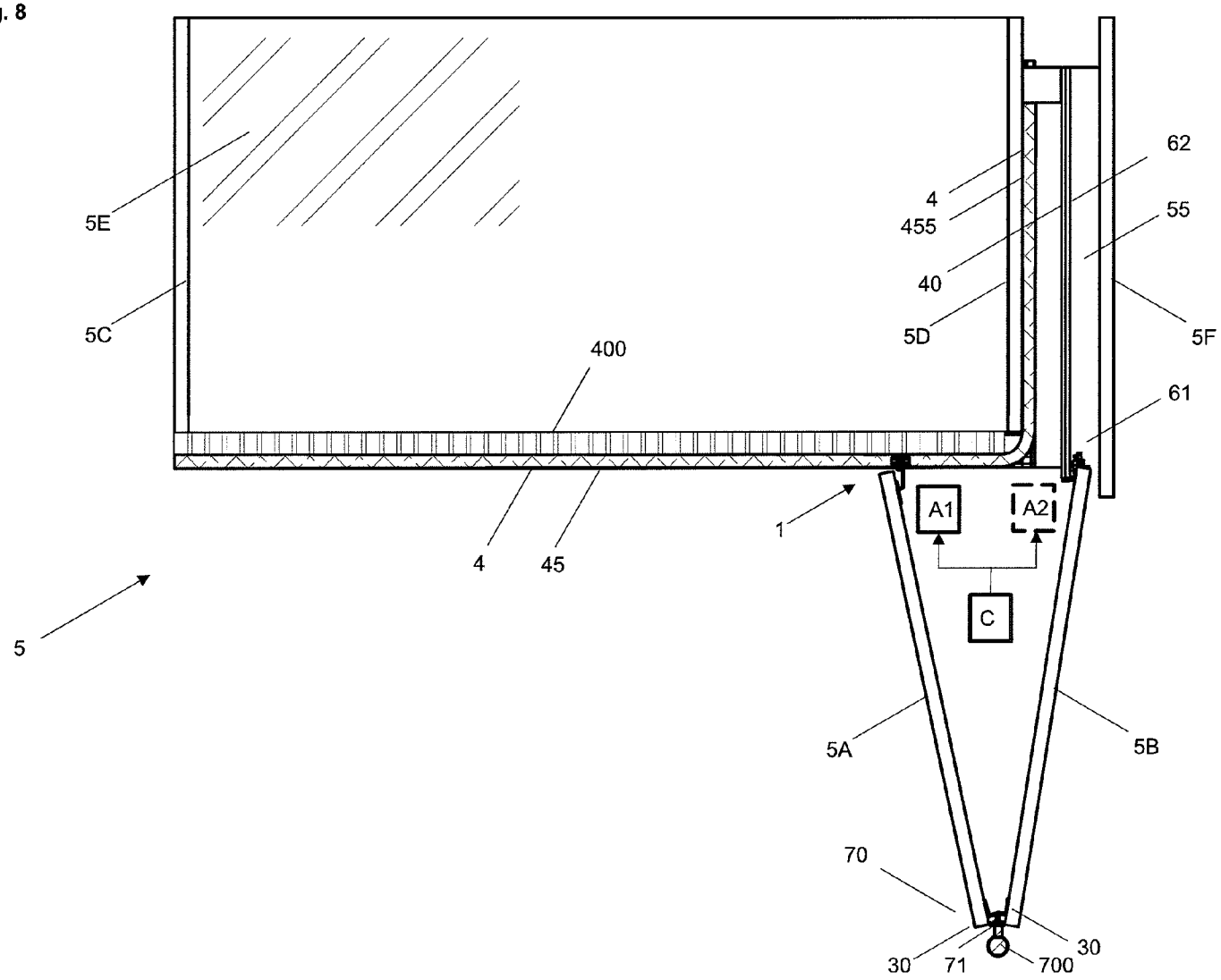
FIG. 8 shows the wardrobe or cupboard 5 of FIG. 7 from above with the running rail 4, which extends along the front side of the wardrobe 5 and further into a door compartment 55, into which the two connected separation elements 5A, 5B can be inserted.

FIG. 7 and FIG. 8 show a wardrobe or a cupboard 5 with sidewalls 5C, 5D, with a cover plate 5E and with a first and a second separation element 5A, 5B, which are connected to one another by joints 70 and which are foldable and can be moved into a door compartment 55. The leading first separation element 5A is holding on the front side an inventive displacement device 1 and is movable along a running rail 4, as shown in FIG. 1A. The two separation elements 5A, 5B are provided with connecting hinges 30 at the sides facing one another. The connecting hinges 30 comprise a connecting hinge lever 320 each, which are pivotally connected pairwise by an articulated shaft 73, as shown in FIG. 10A and FIG. 10B and also shown in FIG. 11-14. Two connecting hinges 30 each and the articulated shaft 73, which connects the connecting hinge levers 320, form a joint 70.

The second separation element 5B is connected on the other side with bracket hinges 30' to a mounting bracket 61, which is held in vertical alignment by a scissor assembly 62 and which, in this preferred embodiment, is movable within the door compartment 55 by means of auxiliary carriages 63.

FIG. 8 shows the wardrobe or cupboard 5 of FIG. 7 from above with the running rail 4, which extends with a first rail section 45 along the front of the wardrobe 5 and further with a second rail section 455 into the door compartment 55, into which the foldable separation elements 5A, 5B can be entered. The door compartment 55, which is laterally delimited by a wardrobe wall 5D and an outer wall 5F, is dimensioned in such a way that the two separation elements 5A, 5B can be received. Hence, the running rail 4, which consists of one or more rail elements, extends practically without intersection or transition from a first terminal position to a second terminal position of the displacement device 1. The inventive guide hinge 3 thereby allows, turning the first separation element 5A relative to the guide carriage 2 by 180°, so that the guide carriage 2 can run ahead when closing or opening the separation elements 5A, 5B.

In a preferred embodiment the guide carriage 2 can be provided with a drive unit A1 as mentioned above. For this purpose the two separation elements 5A, 5B are connected with one another by an articulated joint 70, which holds the two separation elements in symmetrical alignment. In a further embodiment, the two distal sides of the separation elements 5A, 5B are connected to motorised carriages. A motorised carriage 2 connected to the first separation element 5A can be used for folding and unfolding the separation elements 5A, 5B, while a motorised auxiliary carriage 63 connected to the second separation element 5B can drive the separation elements 5A, 5B into and out of the door compartment 55. In further arrangements the guide carriage 2 and the auxiliary carriage can be driven towards one another at first and then together along the running rail 4, e.g. into a park room or staple room. For controlling the drive unit A1 or the drive units A1 and A2 a control unit C is provided.

Figure 9:
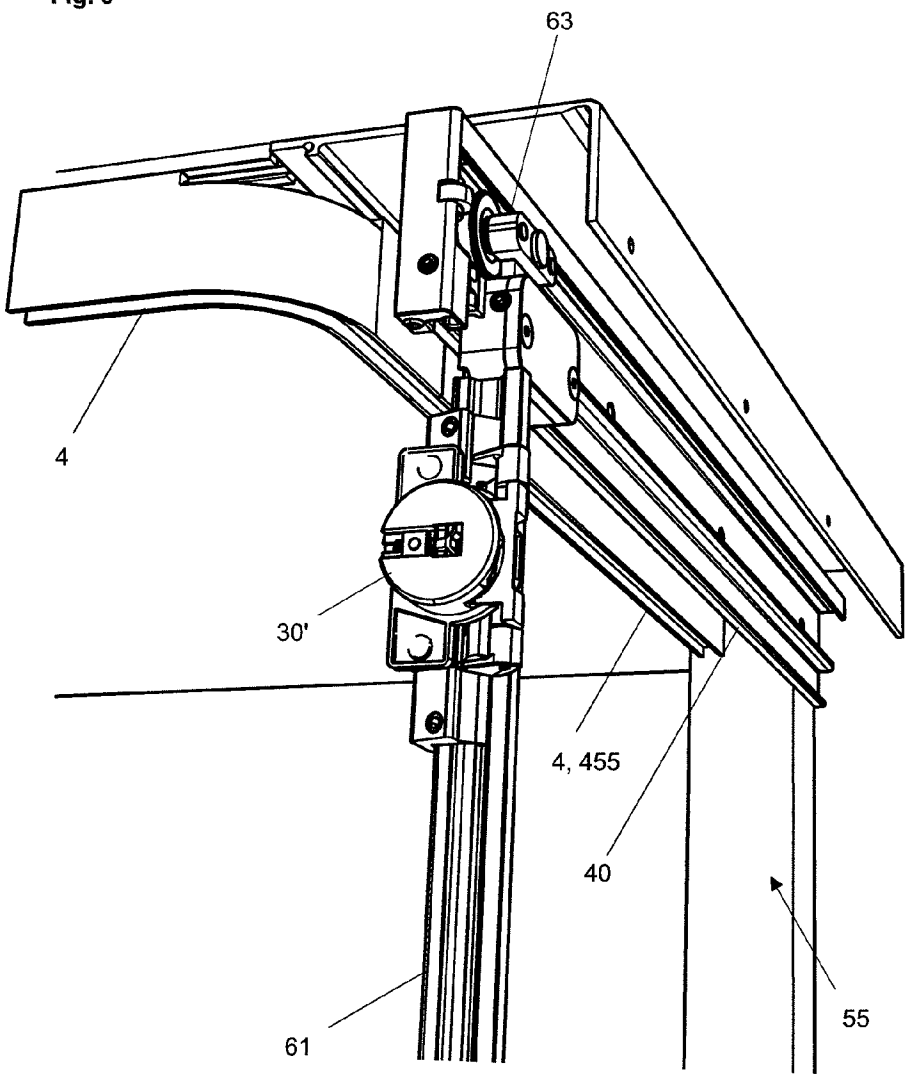
FIG. 9 shows a part of the wardrobe 5 of FIG. 8 without separation elements 5A, 5B and sidewalls with a view to the exposed door compartment 55, into which the running rail 4 extends and in which a lower and an upper auxiliary rail 40 are arranged, along which the mounting bracket 61, which is guided by auxiliary carriages 63 and held by a scissor assembly 62 (not shown) is movable, which mounting bracket 61 can be connected with bracket hinges 30' to the second separation element 5B.

FIG. 9 shows a part of the wardrobe 5 of FIG. 8, without separation elements 5A, 5B and without sidewalls with a view to the auf the exposed door compartment 55, into which the running rail 4 extends and in which a lower (not shown) and an upper auxiliary rail 40 are mounted, along which the mounting bracket 61 can be driven by means of auxiliary carriages 63. The mounting bracket 61 is held in vertical alignment preferably by a scissor assembly 62. Further device is known, with which the mounting bracket can be held in vertical alignment.

FIG. 10A shows partly the two separation elements 5A, 5B, which are connected with one another by connecting hinges 30 and articulated shafts 73. FIG. 10A and FIG. 10B show that the connecting hinge levers 320 of the connecting hinges 30 are provided with hinge sleeves, which are coaxially aligned and are traversed by an articulated shaft 73. The articulated shafts 73 hold clamps 72 that engage in an intermediate bracket 71, which covers the free space between the two separation elements 5A and 5B.

Figure 10C:
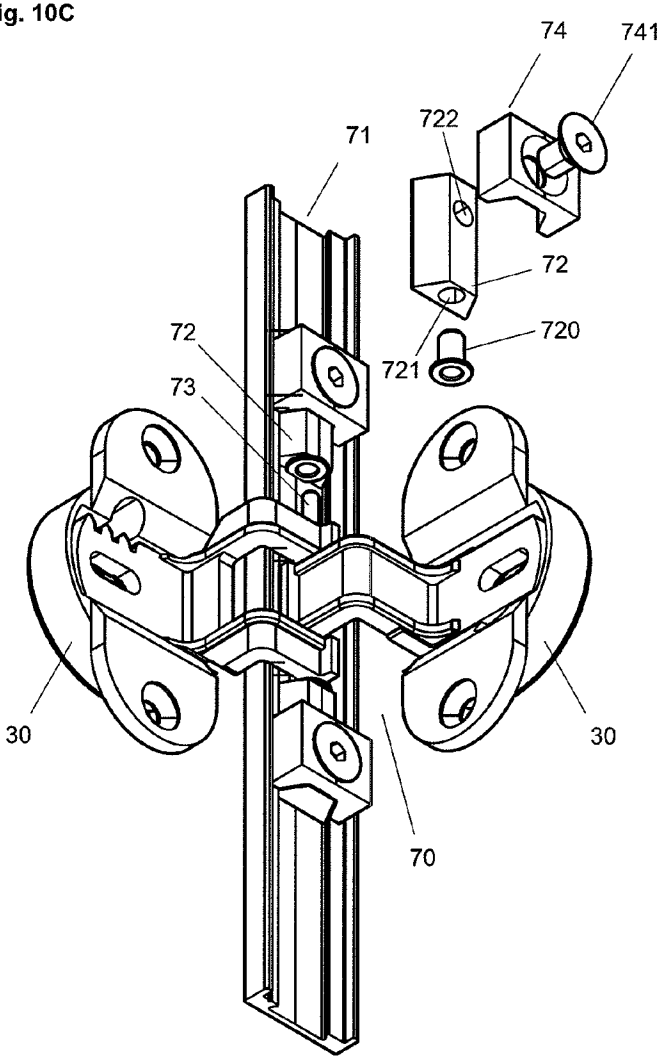
FIG. 10C shows the two connecting hinges 30 of FIG. 10A and the articulated shaft 73, which engages in a bearing sleeve 720 that can be inserted into a wedge shaped clamp 72 that can be fixed on the intermediate bracket 71 by means of a locking element 74.
Figure 10A:
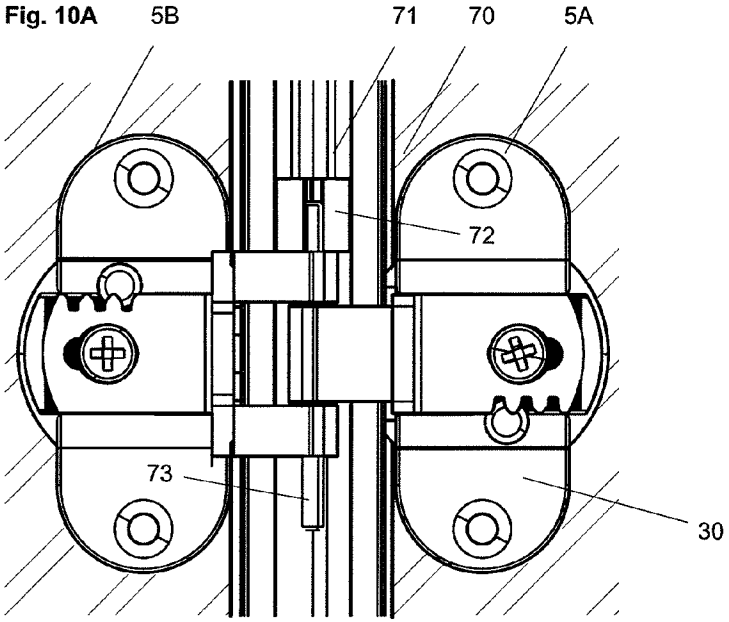
FIG. 10A shows partially the two separation elements 5A, 5B, which are connected with one another by connecting hinges 30 that are connected by an articulated shaft 73, which further holds an intermediate bracket 71.
Figure 10B:
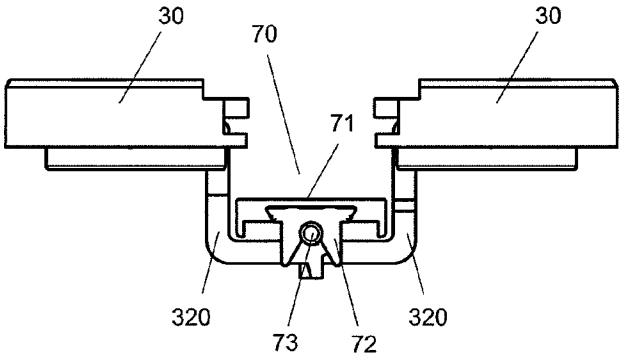
FIG. 10B shows the two connecting hinges 30 of FIG. 10A and the articulated shaft 73, which holds a clamp 72, that engages in the intermediate bracket 71.
Figure 11:
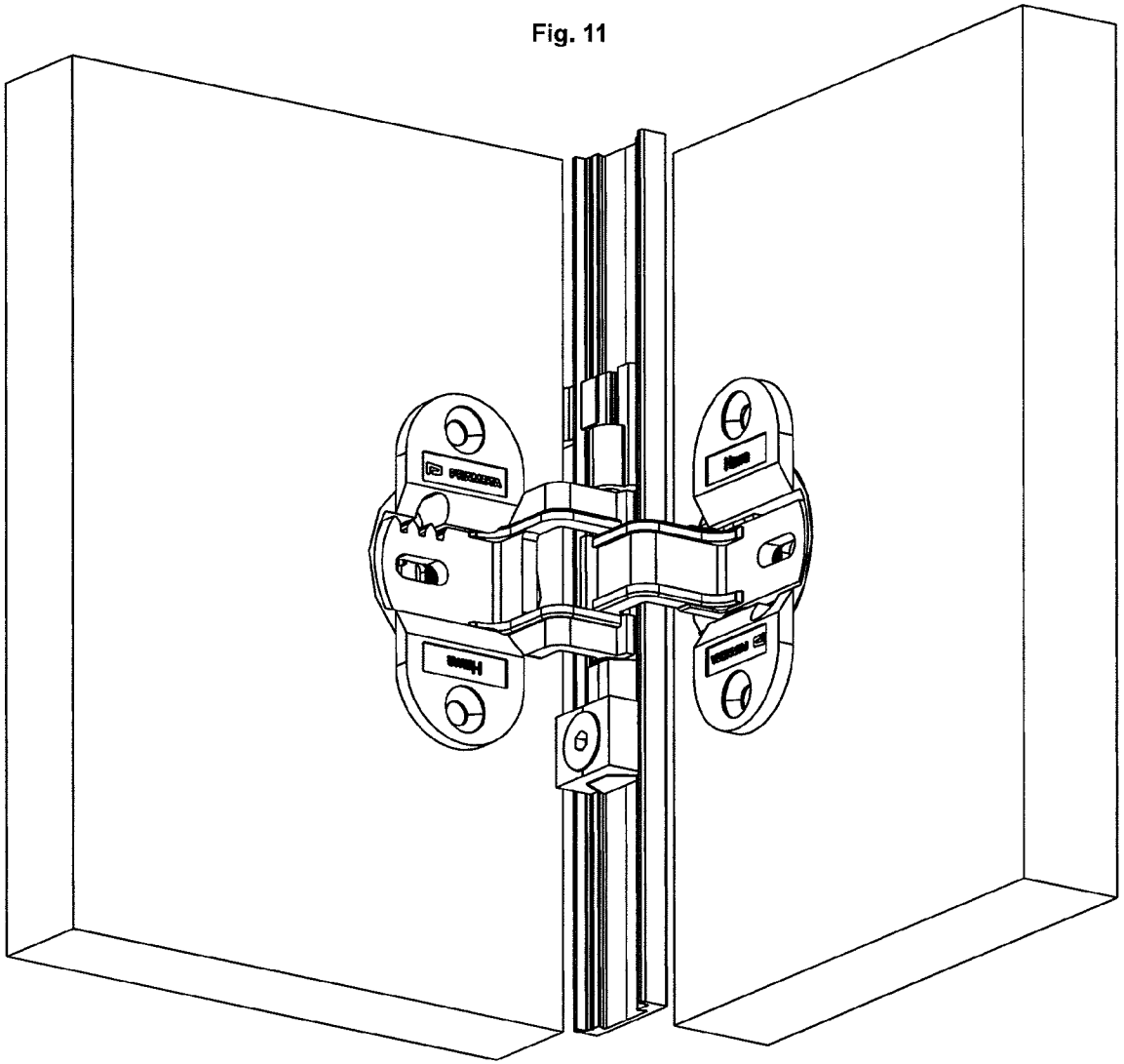
FIG. 11 shows the connecting device of 10C without separation elements with the left hinge turned by 90°.
Figure 12:
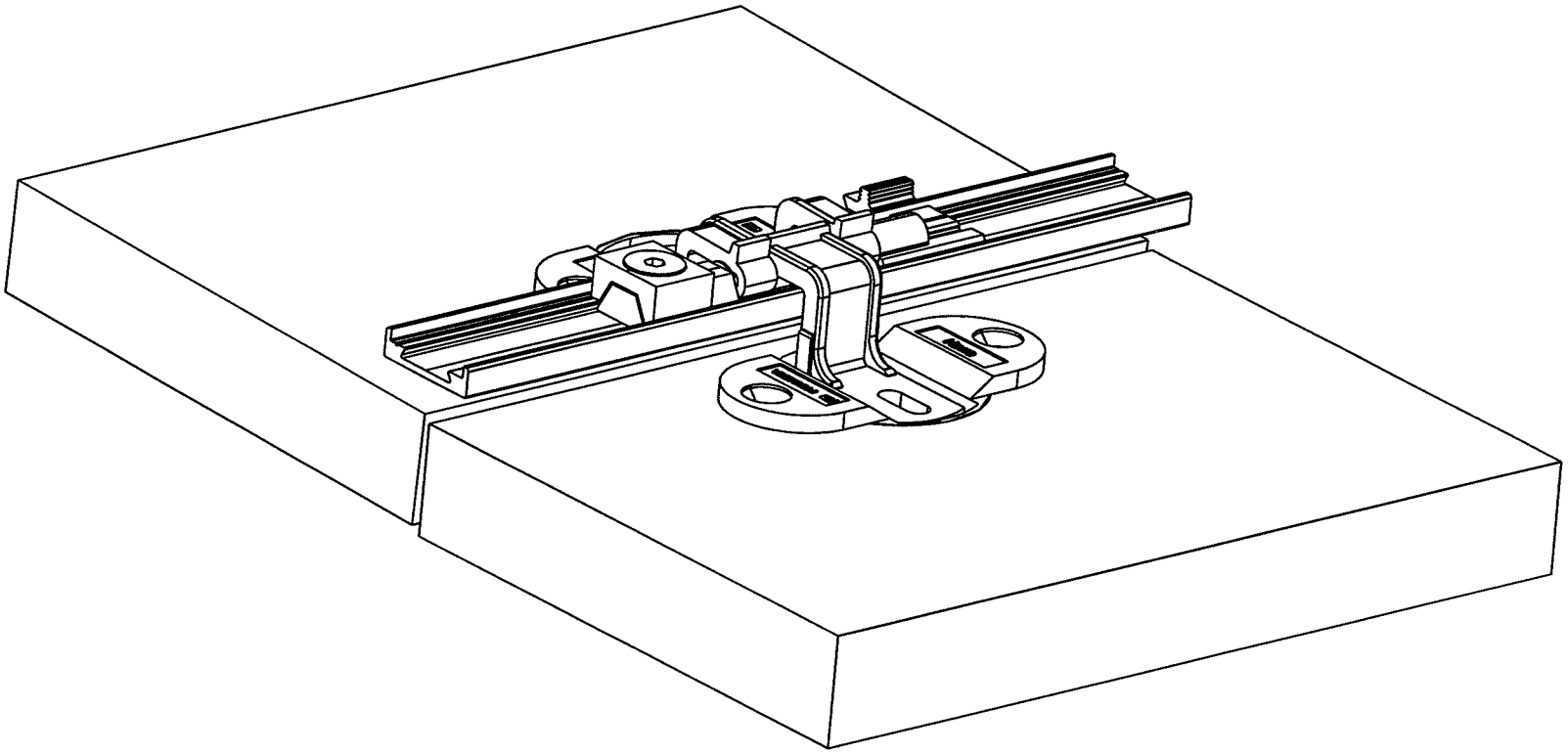
FIG. 12 shows the connecting device of FIGS. 10A and 10B with the separation elements from a different angle.
Figure 13:
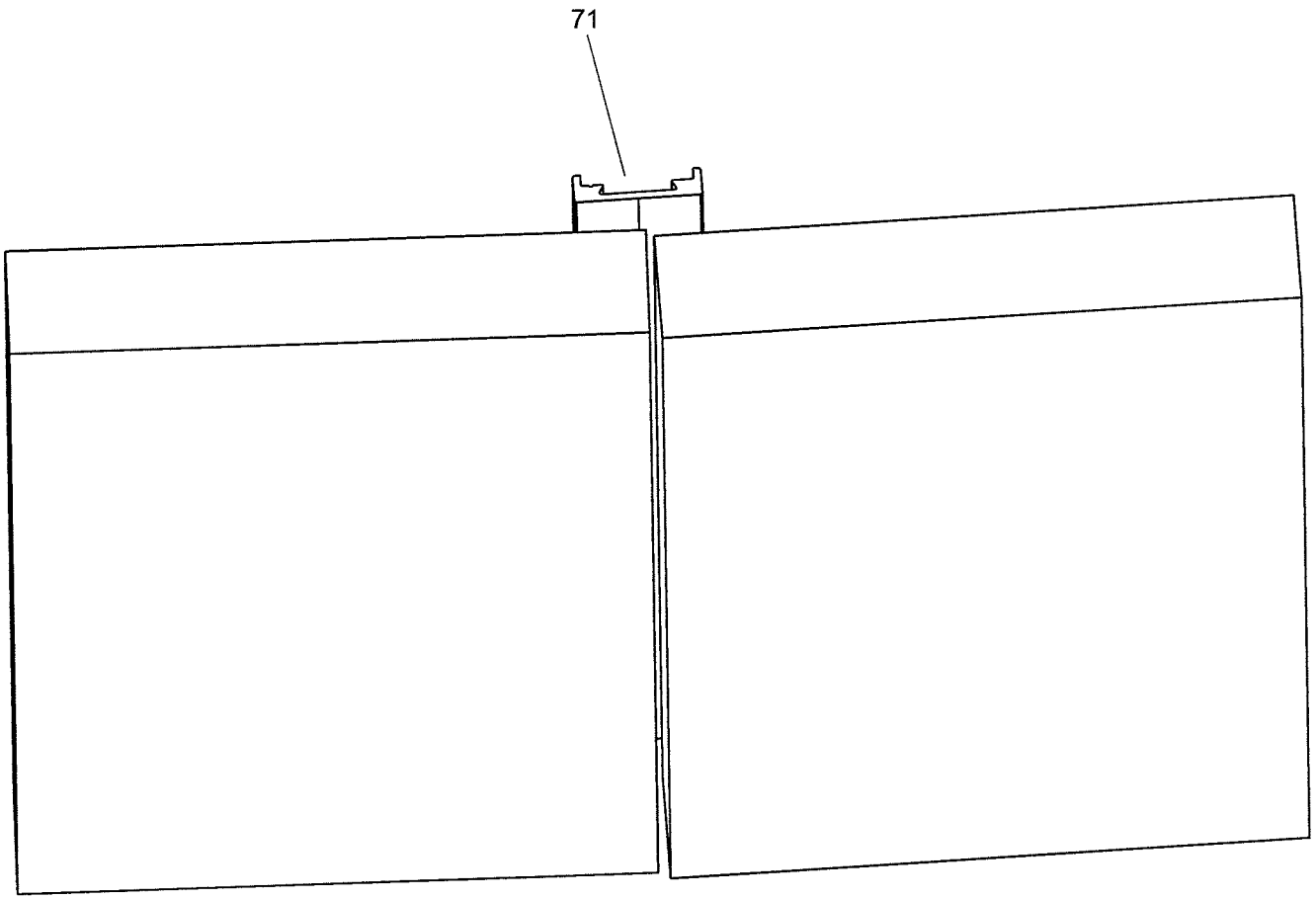
FIG. 13 shows the connecting device of FIGS. 10A and 10B with the separation elements from a different angle.
Figure 14:
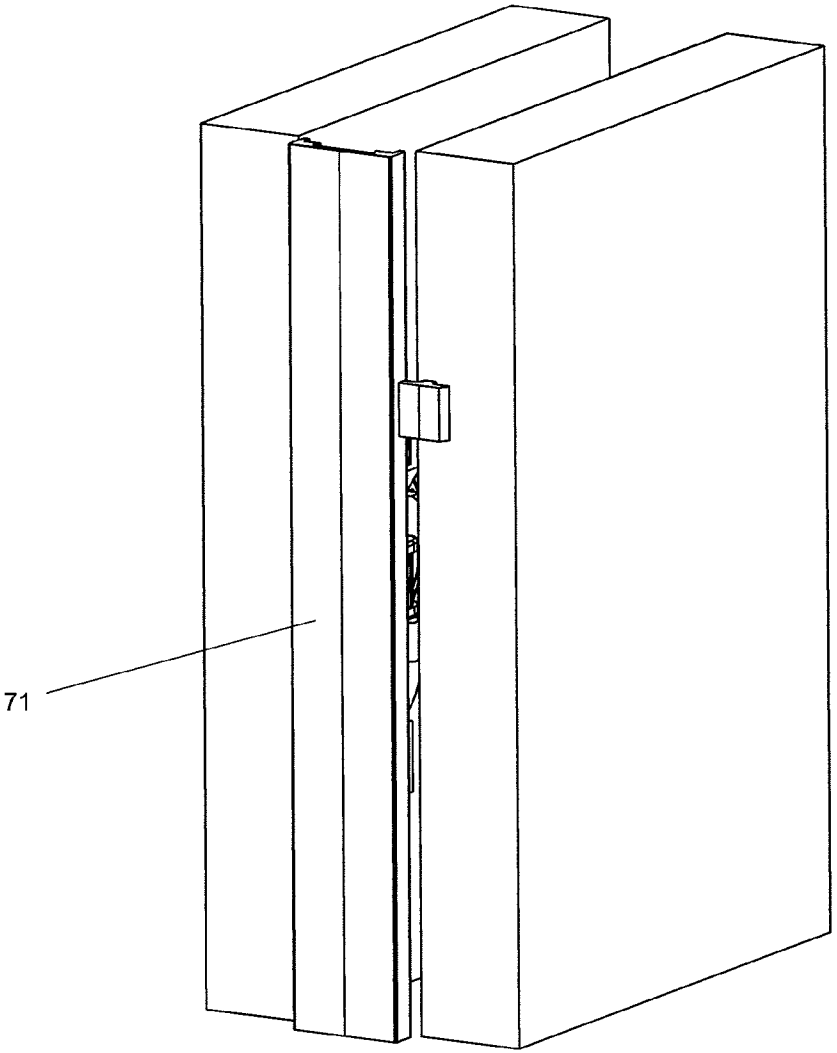
FIG. 14 shows both wings turned by 90° each and aligned in parallel.

FIG. 10C shows the two connecting hinges 30 and the articulated shaft 73 of FIG. 10A. Further, a wedge shaped clamp 72 is shown, which engages in a form locking manner into the intermediate bracket 71 and is slidably held therein and which can be locked by a bridge-shaped locking element 74. The wedge shaped clamp 72 exhibits an axial bore 721, into which a bearing sleeve 720 can be inserted, which serves for receiving the articulated shaft 73. The wedge shaped clamp 72 further comprises a threaded bore 722, which serves for receiving a locking screw 741, with which the wedge shaped clamp 72 can be pulled against the locking element 74, which is supported by the intermediate bracket 71. Thereby the wedge shaped clamp 72 is also connected by force to the intermediate bracket 71 and can no longer be shifted axially.

Hence, the intermediate bracket 71 is connected in a form locking manner to the articulated shaft 73 and therefore with the connecting hinges 30. Hence, for moving the separation elements 5A, 5B the intermediate bracket 71 can be grasped, which is preferably provided with a holding element 700, as shown in FIG. 8. Even under the impact of considerable forces, the intermediate bracket 71 is firmly held by the connecting hinges 30.

Hence, in the event that no electrical drive unit is provided, the two separation elements 5A, 5B can be pulled out of the door compartment 55, can be unfolded, and can be folded and pushed back into the door compartment 55 by means of the holding element 700.

REFERENCED DOCUMENTS

[1] U.S. Pat. No. 8,522,398B2
[2] U.S. Pat. No. 8,303,056B2
[3] U.S. Pat. No. 7,578,096B2

LIST OF REFERENCES

1 displacement device
2 guide carriage
20 carriage body
21 connecting beam
22 carriage foot
220 bolt chamber
2201 chamber opening (front sided)
2202 chamber base
2281 bearing seat
22810 seat recess in the bearing seat (front sided)
2283 base opening
2291, 2292 threaded bores
23 carriage head
26 support wheel
260 wheel axle for the support wheel 26
29, 29A upper guide wheels
29U lower guide wheels
290 wheel axles for the guide wheels 29
3 guide hinge
30 hinge
31 hinge cup
311 hinge bore
312 cup recess
32 hinge lever
320 connecting hinge lever
321 lever plate
322 holding sleeve
3221 sleeve bore
323 lever block
3231 block bore
35 hinge shaft
36 cup insert
360 cup insert recess
361 inclined sidewalls of the cup insert recess 360
4, 4' running rail
40 auxiliary rail
400 adapter plate
41 rail plate
411 front side of the rail plate 41
412 backside of the rail plate 41
42 rail foot
420 running surface
43 rail head
45 first rail section
455 second rail section within the door compartment
5 functional entity, wardrobe, building unit
5A first separation element
5B second separation element
5C, 5*d* wardrobe walls
5E head plate
5F compartment wall
55 door compartment
61 mounting bracket
62 scissor assembly
63 auxiliary carriages
70 articulated joint
700 holding element
71 intermediate bracket
42 clamp
720 bearing sleeve
721, 722 bores in the wedge shaped clamp 72
73 articulated shaft
74 locking element
741 locking screw
8 mounting bolt
81 bolt head
82 bolt shaft
83 bolt foot
831 coupling element
91, 92 adjustment screw
911 coupling element
A1, A2 drive units for the guide carriage and the auxiliary carriage
C control unit for controlling the drive units A1, A2

30' bracket hinge

The invention claimed is:

1. A connecting device for pivotally connecting a first and a second separation element with one another with at least one pair of hinges with a first hinge and a second hinge connected to one another;

said first hinge comprising a first hinge lever provided on the first separation element and said second hinge comprising a second hinge lever;

said first hinge lever connected on one side to a first mounting element that is firmly connectable to a first side of the first separation element and on the other side is pivotally connected to a common hinge element, which is held between the first and the second separation element;

said second hinge lever connected on one side to a second mounting element that is firmly connectable to a first side of the second separation element and on the other side is pivotally connected to said common hinge element;

said first hinge lever and second hinge lever being bent such that the common hinge element is held distant from a plane that is formed by the first sides of the first and second separation element, when the first and second separation element are longitudinally aligned, and that the common hinge element is held between the planes of the first sides of the first and second separation element, when the first and second separation element are aligned in parallel;

wherein the common hinge element comprises an articulated shaft that forms a common pivot axis for the first and the second hinge lever;

wherein the common hinge element comprises an intermediate bracket that is connected to the articulated shaft and that extends along and in parallel to front edges of the first and second separation element when the first and second separation element are longitudinally aligned; and wherein at least one clamp is attached to the intermediate bracket to hold the articulated shaft.

2. The connecting device according to claim 1, wherein the common hinge element is held in front of the first and second separation element, when the first and second separation element are aligned in parallel.

3. The connecting device according to claim 1, wherein the first or second hinge levers each comprise a first end piece that is connected to said articulated shaft and wherein one of the first end pieces of the first and second hinge lever is recessed in such a way that the first end pieces of the first and second hinge lever can be aligned in parallel when turned against one another.

4. The connecting device according to claim 3, wherein the first and second hinge levers are L-shaped.

5. The connecting device according to claim 3, wherein the recessed end piece of the first or second hinge levers comprises two L-shaped lever members that delimit a recess for receiving the non-recessed end piece of other of the first or second levers.

6. The connecting device according to claim 1, wherein the at least one clamp comprises a wedge-shaped clamp element slidably engaged in a form locking manner into the intermediate bracket, a locking means, and an axial bore, in which the articulated shaft is held.

7. The connecting device according to claim 6, wherein the locking means comprise a bridge-shaped locking element and wherein the wedge-shaped clamp comprises a threaded bore, in which a locking screw is held, with which the wedge-shaped clamp is pulled against the bridge-shaped locking element.

8. The connecting device according to claim 1, wherein a holding element is attached to the common hinge element.

9. A displacement device for displacing a first and a second separation element which are pivotally connected with one another by a connecting device;

the connecting device comprising:

at least one pair of hinges with a first hinge and a second hinge connected to one another;

said first hinge comprising a first hinge lever provided on the first separation element and said second hinge comprising a second hinge lever;

said first hinge lever connected on one side to a first mounting element that is firmly connectable to a first side of the first separation element and on the other side is pivotally connected to a common hinge element, which is held between the first and the second separation element;

said second hinge lever connected on one side to a second mounting element that is firmly connectable to a first side of the second separation element and on the other side is pivotally connected to said common hinge element;

said first hinge lever and second hinge lever being bent such that the common hinge element is held distant from a plane that is formed by the first sides of the first and second separation element, when the first and second separation element are longitudinally aligned, and that the common hinge element is held between the planes of the first sides of the first and second separation element, when and the first and second separation element are aligned in parallel;

wherein the common hinge element comprises an articulated shaft that forms a common pivot axis for the first and the second hinge lever;

wherein the common hinge element comprises an intermediate bracket that is connected to the articulated shaft and that extends along and in parallel to front edges of the first and second separation element when the first and second separation element are aligned in parallel; and wherein at least one clamp is attached to the intermediate bracket to hold the articulated shaft.

10. The displacement device according to claim 9, with a guide carriage that is slidable along a running rail and that is pivotally connected to the first separation element, wherein the guide carriage comprises a carriage body with a carriage head and a carriage foot, which carriage head and carriage foot are connected with one another by a connecting beam, wherein the carriage head holds at least one support wheel and at least two guide wheels and wherein the carriage foot is connected torque proof with a first end piece of a hinge lever, whose second end piece is pivotally held by a hinge shaft that is connectable to a sidewall of the first separation element.

* * * * *